United States Patent [19]

Shuck

[11] 4,043,192

[45] Aug. 23, 1977

[54] APPARATUS FOR PROVIDING DIRECTIONAL PERMEABILITY MEASUREMENTS IN SUBTERRANEAN EARTH FORMATIONS

[75] Inventor: Lowell Z. Shuck, Morgantown, W. Va.

[73] Assignee: The United States of America as represented by the United States Energy Research and Development Administration, Washington, D.C.

[21] Appl. No.: 694,117

[22] Filed: June 8, 1976

[51] Int. Cl.[2] ..... E21B 47/10

[52] U.S. Cl. ..... 73/155

[58] Field of Search ..... 73/155, 151, 38; 166/250

[56] References Cited

U.S. PATENT DOCUMENTS 2,747,401 5/1956 Doll ..... 73/38 X

*Primary Examiner*—Jerry W. Myracle

*Attorney, Agent, or Firm*—Dean E. Carlson; Stephen D. Hamel; Earl L. Larcher

[57] ABSTRACT

Directional permeability measurements are provided in a subterranean earth formation by injecting a high-pressure gas from a wellbore into the earth formation in various azimuthal directions with the direction having the largest pressure drop being indicative of the maximum permeability direction. These measurements are provided by employing an inflatable boot containing a plurality of conduits in registry with a like plurality of apertures penetrating the housing at circumferentially spaced-apart locations. These conduits are, in turn, coupled through a valved manifold to a source of pressurized gas so that the high-pressure gas may be selectively directed through any conduit into the earth formation defining the bore with the resulting difference in the pressure drop through the various conduits providing the permeability measurements.

3 Claims, 5 Drawing Figures

APPARATUS FOR PROVIDING DIRECTIONAL PERMEABILITY MEASUREMENTS IN SUBTERRANEAN EARTH FORMATIONS

The present invention relates generally to permeability measurements in subterranean earth formations, and more particularly to a method and apparatus for determining the direction of maximum permeability in such earth formations.

In the recovery of energy values from subterranean earth formations, such as coal beds, oil-bearing sandstones, geothermal formations, and the like, it is necessary to strategically place the wellbores penetrating the formation to effect efficient energy recovery operations. Of major consideration in the placement of the wellbores is the direction of maximum permeability in the earth formation containing the energy values. For example, in the recovery of oil from oil-containing earth formations, the wellbores are strategically placed to take advantage of the maximum permeability direction, particularly if secondary recovery procedures, such as water flooding and hydraulic fracturing, are employed since the flooding and fracture direction are influenced or dictated by the permeability properties of the subterranean earth formation. Also, in the in situ gasification of subsurface coal beds, information relating to the direction of maximum permeability is necessary to assure that the gasification operation proceeds in a desired direction in an efficient manner. The direction of maximum permeability in subterranean earth formation has been determined by employing prior art techniques of taking oriented cores (e.g., 2 to 8 inches diameter), then taking additional smaller cores (e.g., $\frac{3}{4}$ diameter $\times$ 1 inch long) from this core in angular directions and measuring the individual permeabilities of each of the smaller cores. Since these coring and recoring operations usually open small fissures in the materials, the absolute as well as relative directional permeability measurements are somewhat erroneous. In fact, some geological materials, such as coal, cannot be readily cored without breaking apart. Also, with the natural (tectonic) stress field removed from the cores the permeabilities measured are of little value.

The maximum permeability of the subterranean earth formation is frequently oriented along a plane extending nearly parallel to that of the maximum tectonic compressive stress field so that the maximum permeability may be estimated by determining the direction of the tectonic stress field. This determination may be achieved by employing any of several known devices or procedures, such as acoustic emission during and impression packers following fracturing of the earth formation, or by placing suitable strain gauges on the bottom of a wellbore and then overcoring the earth formation to determine the direction of the maximum tectonic stress field.

While the prior art techniques for determining direction of maximum permeability are sufficiently accurate for some materials and of little value for others, they are also time-consuming, cumbersome and relatively expensive to utilize. Accordingly, it is the primary aim or goal of the present invention to provide a method and apparatus for determining the direction of maximum permeability in any type of subterranean earth formation in a manner substantially simpler, less expensive, and more accurate than attainable by employing previously known techniques. To achieve this goal, an inflatable boot containing a plurality of conduits which are in registry with apertures penetrating the boot at circumferentially spaced-apart locations is positioned within a wellbore penetrating the earth formation of interest and inflated sufficiently so as to bear against the walls defining the wellbore in a fluid-tight manner. A fluid at a higher pressure than the pore pressure in the earth formation is then directed through the conduits and injected into the surrounding earth formation defining the bore and the flow rate and pressure drop of the fluid through each of the conduits measured. The orientation of the conduits through which the maximum pressure drop occurs for a given flow rate is indicative of the direction of maximum permeability since the fluid will penetrate the earth formation along a plane parallel to the plane of maximum permeability a greater distance than in a direction departing from this plane, thus providing the greater pressure drop for a given flow rate.

Other and further objects of the invention will be obvious upon an understanding of the illustrative apparatus and method about to be described, or will be indicated in the appended claims, and various advantages not referred to herein will occur to one skilled in the art upon employment of the invention in practice.

A preferred embodiment of the invention has been chosen for the purpose of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated.

Described generally, the present invention is directed to an apparatus and method for determining the direction of maximum permeability in a subsurface earth formation. Applicant has found that an in situ determination of the direction of the maximum permeability in the earth formation can be provided by injecting a high-pressure fluid, e.g., gas or liquid, into the earth formation wherein the penetration of the fluid and the resulting pressure drop are greater in direction parallel to the plane of maximum permeability than in directions departing from the plane of maximum permeability direction. Thus, even though the flow of fluid into the earth formation along the plane of maximum permeability provides a relatively small pressure drop, it is sufficient to readily detect to thereby afford a mechanism for providing an accurate reading indicative of the directional characteristics of the subsurface earth formation. The pressures and flow rates being monitored remotely at the surface permit adjustment of the flow rates for any permeability strata such that the desired range of pressure drops will result for any desired accuracy, linear range, etc. Various techniques of adjusting either the pressure or flow rate to a constant value for each conduit and measuring the resulting flow rates or pressures, which ever is being controlled, can be used to yield optimum measurements for various reservoir conditions.

While the present invention is primarily directed to determining permeability directional characteristics, it is also applicable for measuring the extent or magnitude of permeability. In this aspect of the invention the extent of pressure drop and flow rate of the fluid penetrating the earth formation is directly proportional to the magnitude of permeability. Thus, by determining both the direction and extent of permeability energy recovery operations can be greatly facilitated.

Figure 1:
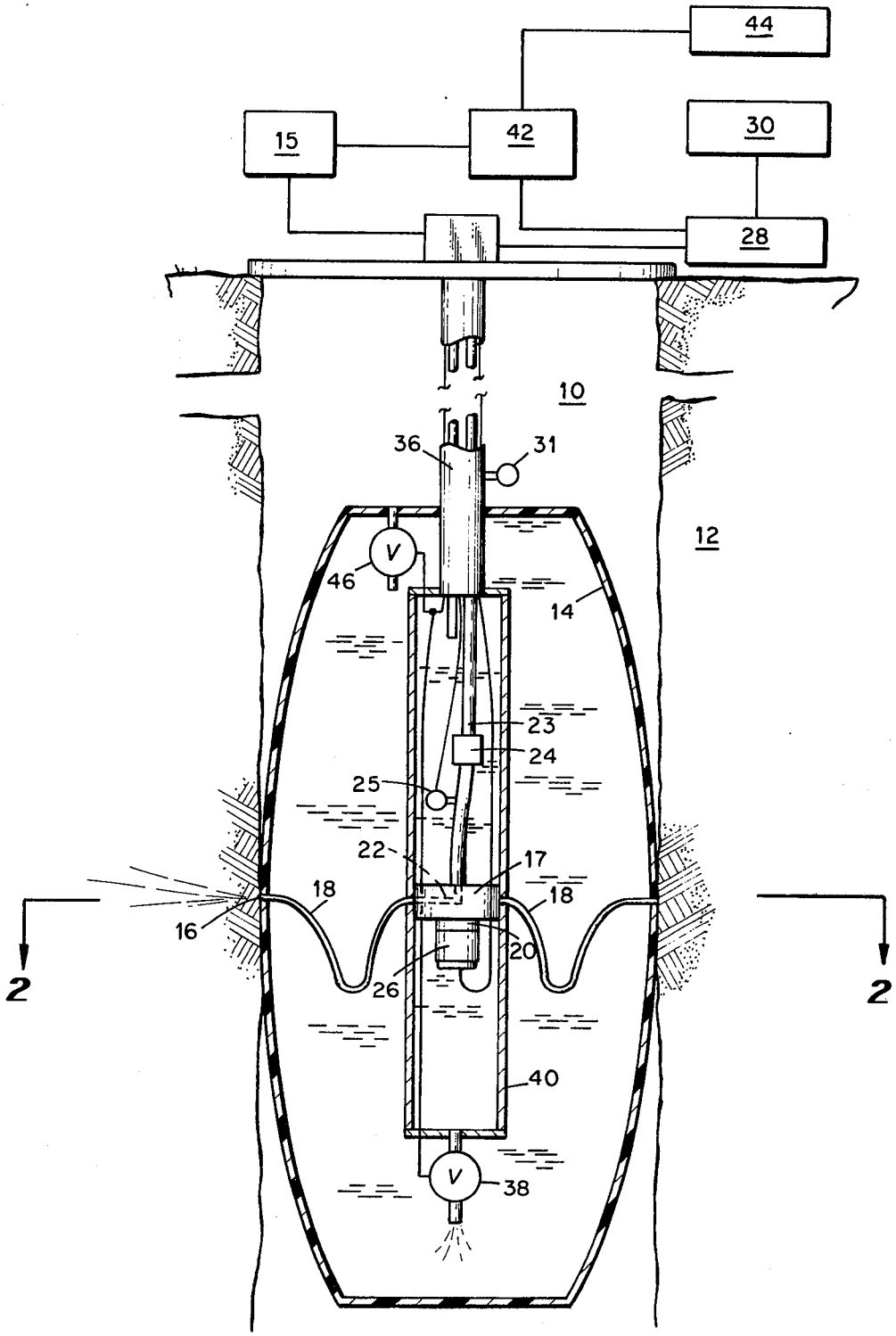
FIG. 1 is a schematic illustration of a form of the inflatable boot and manifold system of the present invention which is useable in a wellbore penetrating a subterranean earth formation for determining the direction of maximum permeability and other permeability characteristics in the earth formation.
Figure 2:
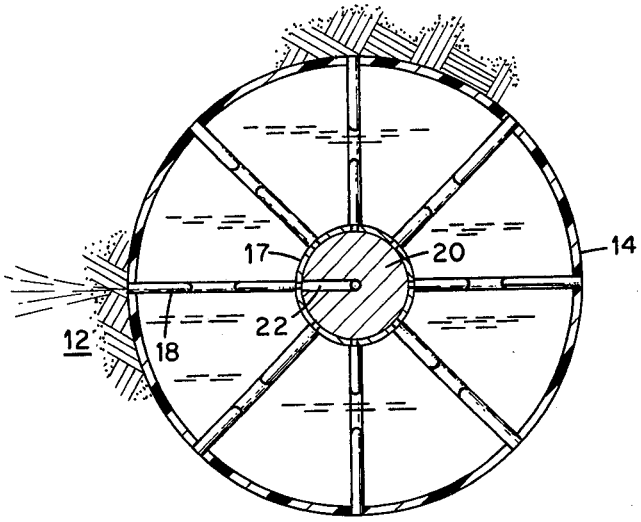
FIG. 2 is a sectional plan view illustrating the manifold configuration of the FIG. 1 embodiment.
Figure 3:
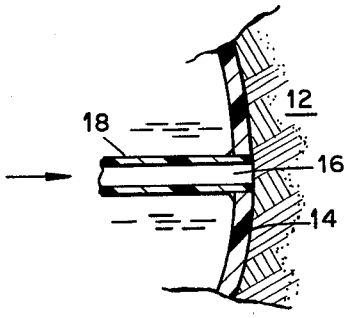
FIG. 3 is a segmented sectional view showing details of the FIG. 1 boot and a gas-conveying conduit in registry with the subterranean earth formation.

The apparatus shown in the accompanying drawings may be utilized to provide in situ measurements of the permeability characteristics in subterranean earth formations in accordance with the teachings of the present invention. As shown in FIG. 1, the subject apparatus is disposed in a wellbore 10 penetrating a subterranean earth formation 12 and comprises an inflatable housing or boot 14 which may be spherical or of a generally cylindrical configuration, as shown, and formed of rubber or any suitable elastic material which will allow the boot to be readily positioned within the wellbore 10 and selectively expanded or inflated by any suitable pressurizing medium, such as a liquid or gas, so as to bear in an essentially air-tight manner against the walls of the subterranean earth formation defining the wellbore 10. With the boot 14 inflated and bearing against the walls of the wellbore, fluid from a suitable pressure source, as generally shown at 15, may then be injected through strategically placed apertures or ports 16 extending through the wall of the boot 14 so as to penetrate the earth formation with the direction of injection showing the greatest pressure drop and flow rate being indicative of the direction of maximum permeability. Also, as mentioned above, the extent of the pressure drop and flow rate corresponds to the magnitude of permeability in the subsurface earth formation.

In order to provide an arrangement by which permeability readings may be gathered about the entire circumference of the wellbore with a single positioning of the inflatable foot 14, a valved fluid injecting manifold system may be used. This manifold system 17 is mounted within the boot 14 and coupled to the ports 16 through a plurality of conduits 18. The conduits 18 may be sealed to the walls of the ports 16 in any suitable manner, such as by employing a conventional adhesive or other suitable sealing means. The conduits 18 may be commercially available high-pressure hoses which are formed of a sufficiently flexible material so that inflation and deflation of the boot will not materially affect the fluid conveying function of the conduits. A satisfactory arrangement of the conduits 18 is to use high-pressure hoses of sufficient lengths that a small loop or curve is present in the hose between the manifold and the boot so that changes in the boot diameter will not place an unreasonable strain upon the conduits or the couplings therewith.

In order to selectively inject the high-pressure gas through the conduits 18 to determine the permeability properties of the subterranean earth formation with respect to direction and magnitude of permeability, the manifold 17 may incorporate a suitable stepping valve 20 containing a single passageway 22 which may be selectively placed in registry in serial manner with the conduits 18 disposed about the circumference of the manifold 17. The passageway 22 is, in turn, coupled through a suitable conduit or line 23 to the source 15 of the high-pressure reservoir for the fluid substance used for the permeability measurements. In line 23 are two sensors or transducers 24 and 25 which measure the fluid flow rate and the line pressure, respectively, and transmit the signals to the surface through a conventional well logging (e.g., 7 conductor) cable for surface monitoring and control. The stepping valve 20 may be operated by any suitable drive, such as the motor shown at 26, which may be pneumatically or electrically operated in a stepwise fashion. Thus, by rotating the stepping valve 20 in increments about the circumference of the manifold 17 and determining the extent of pressure drop through each conduit 18 as the manifold is placed in registry therewith and pressurized for a period of time ranging from about 1 to 15 minutes, the pressure drop through the conduits will provide a reading indicative of the directional properties of the maximum permeability in the earth formation as well as a fairly accurate reading indicative of the extent of permeability. These pressure drop readings may be provided by pressure sensing and recording instruments, such as a conventional strain gauge-type pressure transducer or a piezoelectric-type pressure transducer. These instruments are generally indicated at 24 and 25 with the remote readout indicator shown at 28 and 30 in FIG. 1. The pore or wellbore fluid pressure is also monitored by a similar type transducer 31 to aid in adjusting the proper inside boot pressure and in the theoretical calculations for directional permeability studies.

Alternatively, while a stepping motor arrangement is shown in the illustrated embodiment, it will appear clear that a plurality of conduits may project from the high-pressure fluid source 15 with each of these conduits being coupled to the boot as shown by the conduits 18. Thus, with all the conduits in registry with the pressure source they may be simultaneously filled with the high pressure gas, the pressure drop through each conduit being analyzed and recorded simultaneously by multiples of instrumentation 24, 25, 28, and 30 so as to show the direction and magnitude of the maximum permeability. Also, the high pressure fluid reservoir may be a part of the cannister located down hole at the formation depth.

Figure 4:
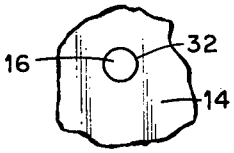
FIGS. 4 and 5 show different configurations of apertures in the boot of FIG. 1 that are satisfactory for providing permeability measurements in accordance with the present invention.
Figure 5:
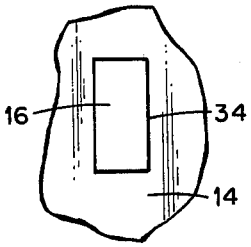

The ports 16 in the boot, as shown in FIGS. 4 and 5, may be of any suitable configuration and material which will allow for the desired contact with the subsurface earth formation. For example, the ports may be defined by walls of a round configuration 31 (FIG. 4) or a rectangular configuration 34 (FIG. 5). The particular geometry of the port penetrating the boot is not critical in that any opening which will provide desirable contact with the earth formation as well as provide contact with a sufficiently large surface area of the earth formation will be satisfactory for practicing the present invention.

The inflatable boot 14 may be lowered into a wellbore 10 by employing a shielded cable 36 which houses the high-pressure fluid lines and supports the boot 14. With the inflatable boot 14 lowered to the desired location within the subsurface earth formation, the boot 14 may be inflated by opening a valve or other suitable fluid flow control means as shown at 38 so as to introduce the high-pressure fluid from source 15 to fill the boot and expand the latter against the walls of the wellbore. Alternatively, the fluid for pressurizing the boot 14 may be contained within the housing 40 disposed within the boot. The boot-inflating pressure is required to be greater than the pore pressure in the earth formation surrounding the boot in order to force and maintain the boot against the walls of the wellbore 10 in an air-tight manner. For example, a satisfactory seal may be achieved by employing a boot-inflating pressure of about 15 psi greater than the pore pressure. With the boot 14 positioned in the wellbore in a known orientation as determined by a remote indicating compass or gyrocompass system conventionally used for well surveys, high pressure fluid is then selectively injected through each of the conduits 18 as the stepping valve 20 rotates about the entire circumference thereof. The pressure drop and/or flow rate through each of the lines 18 is then adjusted, indicated, and recorded in the instruments 28 and 30 so as to provide the directional properties and permeability of the subsurface earth formation. If desired, a computing module 42 which takes the pressures and flow rates as input data may be programmed and used to calculate permeabilities and other reservoir parameters and characteristics from these data and plot the same on a circular or chart recorder 44.

It may be desirable to provide several readings at various locations or levels within the wellbore to assure that anomalies at any one location therein will not provide erroneous readings. This multiple-location reading operation may be readily achieved by deflating the boot 14 by bleeding off the fluid pressure therein in any suitable manner, such as by allowing it to vent through a valve 46 in the boot. With the boot deflated to a smaller diameter, it may be raised or lowered to any suitable location within the wellbore and then re-inflated and the sequential readings of the pressure drops and flow rates through the various conduits 18 retaken, as described above.

It will be seen that the present invention provides an apparatus and method for determining permeability characteristics of subsurface earth formations in situ in a relatively simple manner which is substantially more rapid and provides an accuracy level substantially greater than previously obtainable. Further, the apparatus of the present invention may be used for any wellbore having a diameter in the range of about 2 inches to 10 feet since expandable boots of different sizes may be readily used.

What is claimed is:

1. A device for providing in situ measurements indicative of the direction of maximum permeability and the magnitude of the permeability in a subterranean earth formation, comprising an inflatable housing containing a plurality of apertures penetrating the housing at circumferentially spaced-apart locations, means for selectively inflating said housing within a wellbore penetrating said earth formation to place said apertures in registry with said earth formation, a plurality of conduits within said housing coupled to said apertures and to a source of high-pressure fluid, means for selectively directing high-pressure fluid from said source through selected conduits tc said earth formation, and means responsive to the pressure drop of the high-pressure fluid through said conduits for providing measurements indicative of the direction of maximum permeability and the magnitude of permeability in said subterranean earth formation.

2. The device claimed in claim 1, wherein said inflatable housing is formed of an elastic material and is sufficiently expandable so as to bear against said earth formation in a substantially fluid-tight manner at portions thereof defining and contiguous to said apertures.

3. The device claimed in claim 1, wherein a manifold is disposed in said housing, said conduits are in registry with said manifold, and wherein valve means in said manifold is operable for selectively and sequentially coupling said conduits to said source of high-pressure fluid.

* * * * *